US005111993A

United States Patent [19]

Baker

[11] Patent Number: 5,111,993

[45] Date of Patent: May 12, 1992

[54] WATER SPRINKLER

[75] Inventor: Paul J. Baker, Kenmore, N.Y.

[73] Assignee: The Quaker Oats Company, Chicago, Ill.

[21] Appl. No.: 550,721

[22] Filed: Jul. 10, 1990

[51] Int. Cl.[5] ..... B05B 1/00

[52] U.S. Cl. ..... 239/211; 239/251; 239/381; 239/446

[58] Field of Search ..... 239/211, 237, 251, 261, 239/289, 380, 381, 446, 448

[56] References Cited

U.S. PATENT DOCUMENTS 3,178,116 8/1963 Cucuzza et al. ..... 239/211
3,675,850 7/1972 Ebert ..... 239/261
4,550,876 11/1985 Kulesza et al. ..... 239/211

*Primary Examiner*—Andres Kashnikow
*Assistant Examiner*—Lesley D. Morris
*Attorney, Agent, or Firm*—Cumpston & Shaw

[57] ABSTRACT

A water sprinkler is disclosed having a rotatable water driven nozzle member and a stationary spout for simultaneously discharging a twirling stream of water from the nozzle member and a pulsating stream from the spout. A chamber is provided within which a pulsating valve is rotatably mounted about its hollow stub shaft. The shaft is secured to the nozzle member for rotation therewith, and allows passage of water from a water inlet through the nozzle member. The stub shaft of the pulsating valve further has a laterally extending segmented plate for intermittently opening and closing the spout for allowing a pulsating stream of water to pass therethrough. The water sprinkler is further provided with one or more water outlets connectable to a hose or spray forming nozzle. A rotary valve is provided for selectively connecting the water inlet to a selected one of the chamber and water outlets. The outer housing of the water sprinkler is formed to simulate a colorful fire hydrant.

15 Claims, 3 Drawing Sheets

WATER SPRINKLER

FIELD OF THE INVENTION

The present invention relates generally to water sprinklers, and more particularly to a water sprinkler simulating a colorful fire hydrant for simultaneously discharging twirling and pulsating streams of water.

BACKGROUND OF THE INVENTION

In the adult world, water sprinklers of varied type are well known to assist home owners in developing an immaculate, beautiful green lawn, of heavy thick grass.

In the world of play, fantasy and make-believe, children tend to spend a considerable amount of their time with toys simulating counterparts in the adult world. The water sprinkler of this invention not only performs the utilitarian function of watering a lawn, but also indulges the fantasy and world of make-believe for children by simulating a colorful fire hydrant.

SUMMARY OF THE INVENTION

An object or aspect of the present invention is to provide a water sprinkler that not only serves the utilitarian function of watering a lawn, but also functions as a children's toy by simulating a colorful fire hydrant. The water sprinkler has a water inlet adapted when connected to a pressurized source of water to simultaneously discharge twirling and pulsating streams of water. The water sprinkler comprises a chamber hydraulically connectable to the water inlet, and having separate first and second water outlets. A hollow nozzle bar member having a jet outlet is rotatably mounted on the chamber, and is hydraulically connected to the first water outlet. The nozzle bar member is rotatably driven by the pressurized water passing therethrough for discharging a twirling stream of water from the jet outlet. A pulsating valve means is rotatably mounted within the chamber, and is coupled to the nozzle member and rotatably driven thereby. The valve means intermittently opens and closes the second water outlet, causing a pulsating stream of water to be discharged from the sprinkler simultaneously with the discharging of the twirling stream.

Another object or aspect of the invention is to provide the pulsating valve means with a hollow stub shaft rotatably mounted within the first water outlet for securement to the nozzle member, and for allowing water to flow thereto.

In still another object or aspect of the present invention, the valve body is provided with a segmental plate radially extending from the stub shaft within the chamber for intermittently blocking passage of water through the second water outlet during each rotation of the valve body.

In another object or aspect of this invention, the segmental plate is substantially semi-circular in shape and is synchronized with the nozzle bar member for blocking the second water outlet during passage of the nozzle bar member thereover.

In still another object or aspect of the invention, the chamber is provided with a spout extending outwardly from the second water outlet. A dome top is mounted on the nozzle bar member for rotation therewith. The dome top has a port extending therethrough in alignment with the jet outlet, and an opening extending therethrough in alignment with the spout.

In a more specific object or aspect of the invention, the water sprinkler is provided with a selective rotary valve means interposed between the water inlet and the chamber and any other water outlets for selectively directing pressurized water into one of the chamber and outlets.

In still another object or aspect of the present invention, the water sprinkler is provided with an exterior housing that simulates a colorful fire hydrant to make the water sprinkler more entertaining and interesting to children as a toy.

The invention and its objects and advantages will become more apparent from the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF A PREFERRED EMBODIMENT

Because certain parts of water sprinklers and related apparatus are well known, the following description is directed in particular to those elements forming, cooperating directly with, or relating to the present invention. Elements not specifically shown or described herein are selectable from those known in the art.

Figure 2:
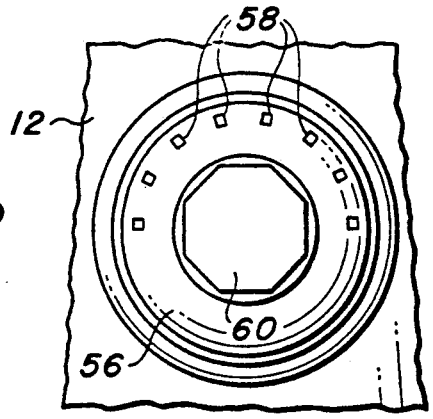
FIG. 2 is a segmental elevational view of a fan spray outlet of the sprinkler taken from line 2—2 of FIG. 1.
Figure 1:
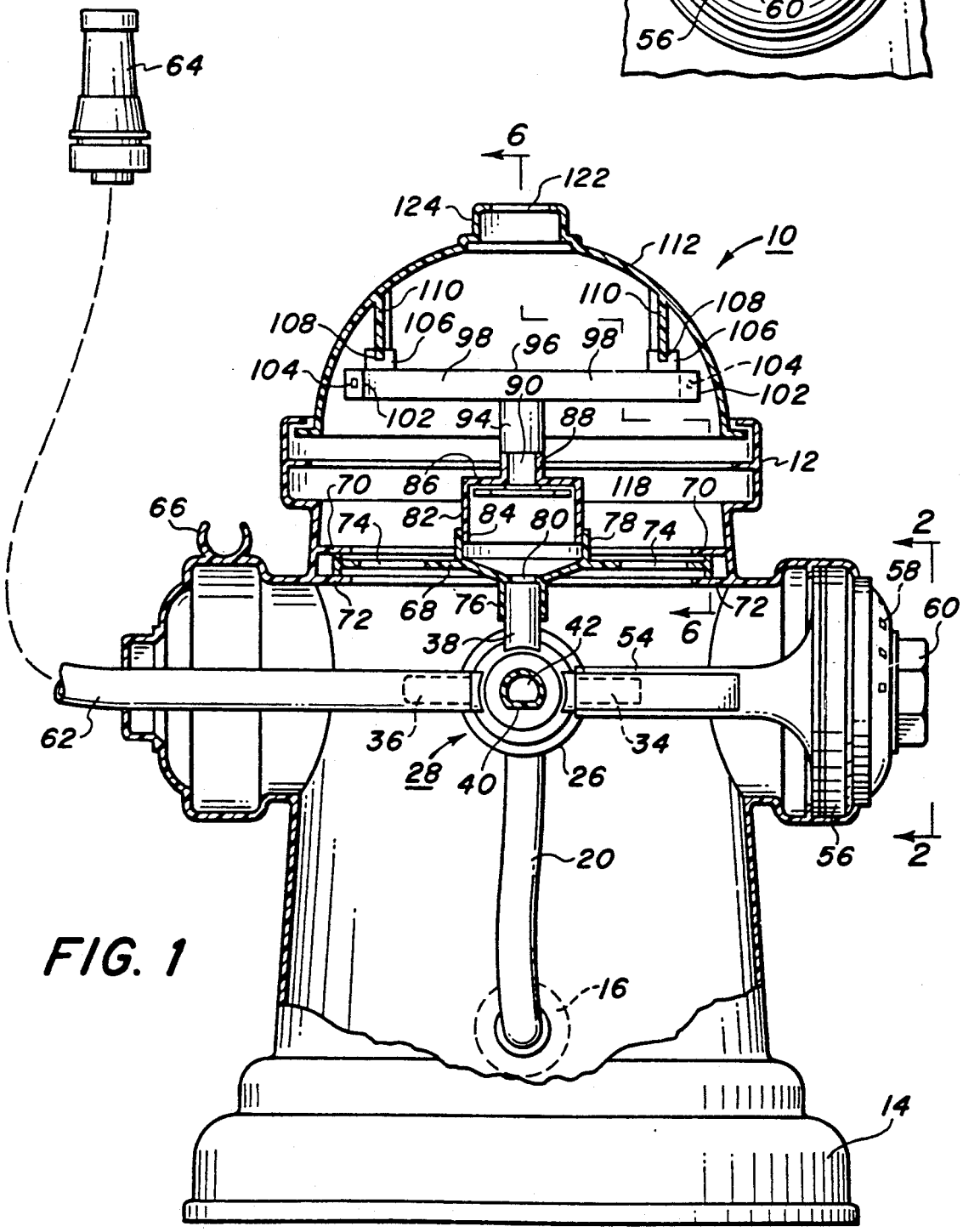
FIG. 1 is a front elevational view of a water sprinkler constructed in accordance with a preferred embodiment of the present invention in which a portion thereof is broken away and sectioned.
Figure 4:
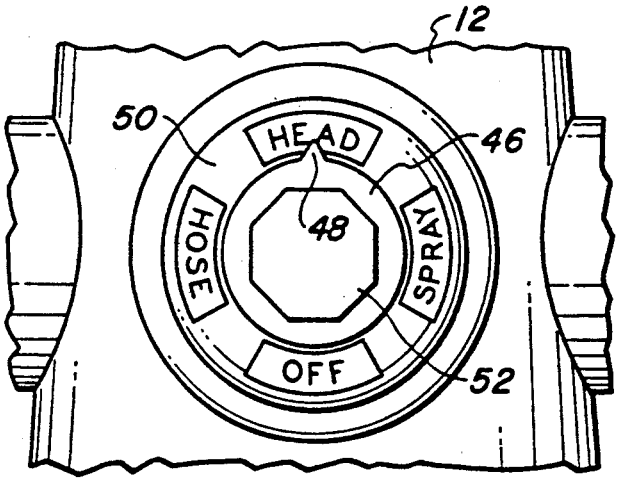
FIG. 4 is a segmental elevational view of the rotary valve taken substantially from line 4—4 of FIG. 3.
Figure 5:
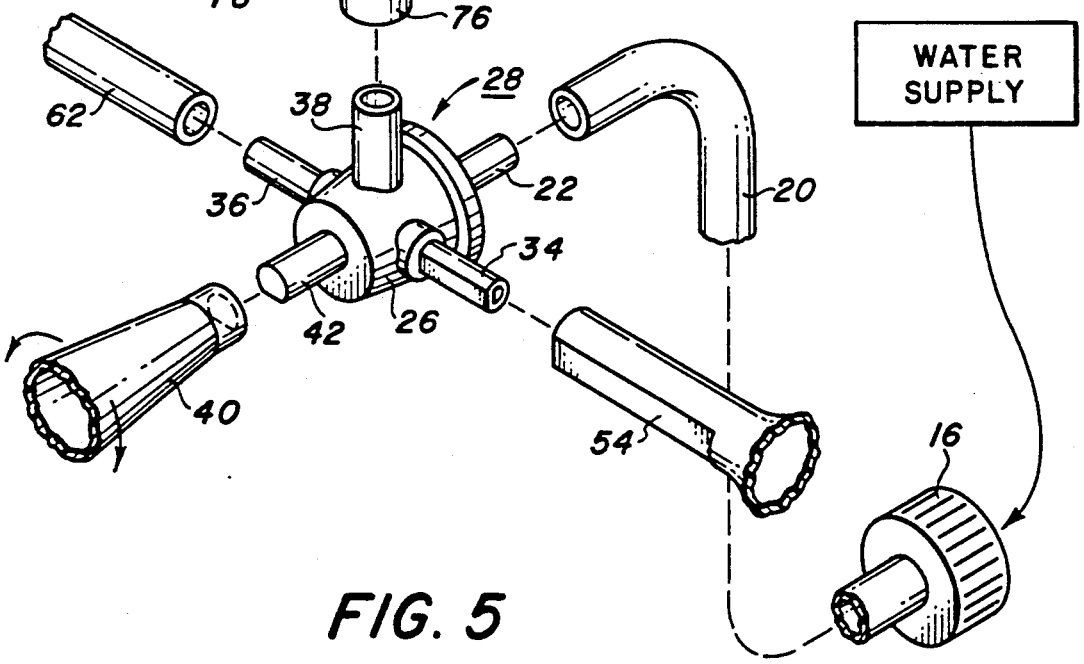
FIG. 5 is an exploded view in perspective of the functioning portions of the water sprinkler of this invention with the exterior housing omitted for purposes of clarity.

With reference to FIGS. 1–5, a preferred embodiment of the water sprinkler 10 of this invention comprises an exterior housing 12 shaped to simulate a colorful fire hydrant in a fanciful and at least slightly abstract way. The housing has a support base 14, and adjacent the support base is mounted a garden hose adapter 16, as best seen in FIGS. 1 and 5. A rotatable part of the garden hose adapter is connectable to one end of a garden hose 18 in a known manner, and the opposite hose end is connectable to a water supply under pressure, such as a home faucet.

Figure 3:
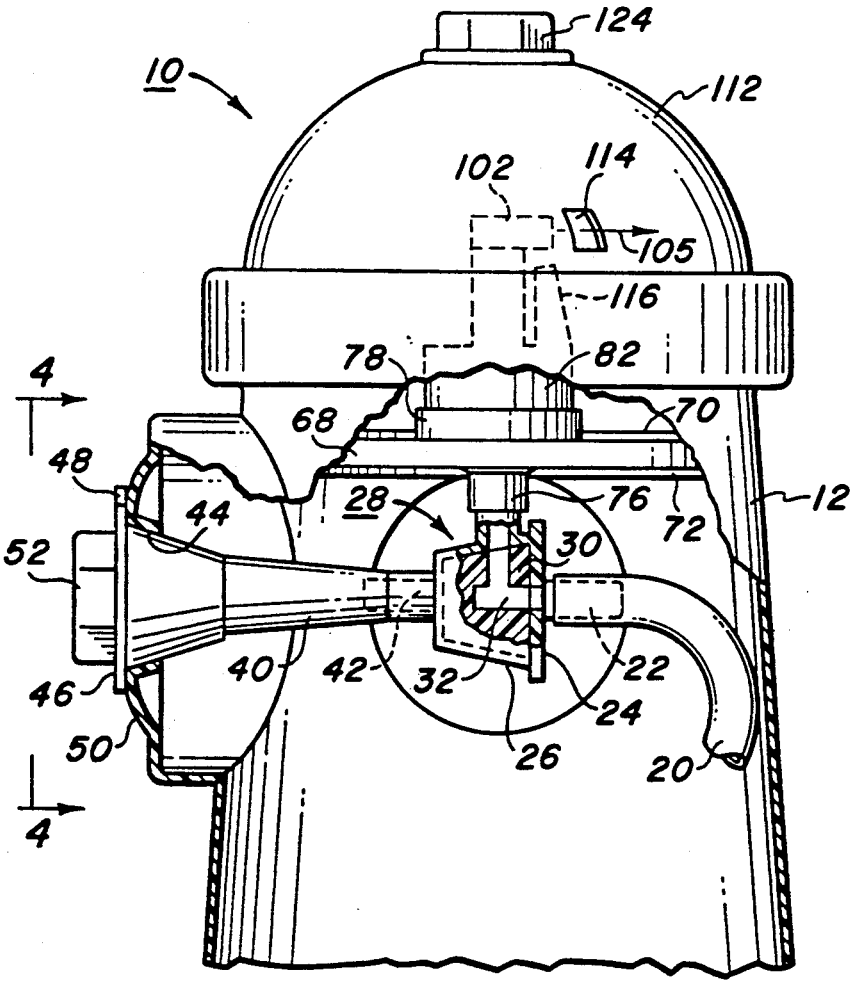
FIG. 3 is a segmental side elevational view of the water sprinkler of this invention with a portion thereof removed and sectioned to show the rotary valve means.

With particular reference to FIGS. 1, 3, and 5, a hose section 20 connects a hollow stem of the hose adapter 16 to a water inlet nipple 22 mounted on a back plate 24 of an outer fixed casing 26 of a 3-way valve 28 (FIG. 3). The 3-way valve has a frustoconically shaped body 30 mounted for sliding rotation within a corresponding cavity in the outer casing 26. The valve body 30 has an L-shaped groove 32 therein for connecting the water inlet nipple 22 to one of three different valve water outlets, namely, a spray outlet 34, a hose outlet 36, and a sprinkler head outlet 38.

Referring to FIGS. 1, 3, and 4, the valve body 30 is rotatable by a funnel-shaped arm 40 having one end thereof connected to a spindle 42 on the valve body 30, and the opposite end thereof nesting within a frustoconically shaped opening 44 in the sprinkler housing 12. The opposite end of arm 40 further has an annular disk 46 provided with a pointer 48 for indicating on the face 50 of the housing surrounding the opening 44, the position in which the valve body 30 is placed. A control knob 52, simulating a large nut on the end of an arm of a fire hydrant, is secured to the arm 40 for selectively moving the arm and valve body 30 among four different positions.

In one position, the valve body groove 32 directs water from the water inlet in nipple 22 through water spray outlet 34, as best seen in FIGS. 1 and 5. A bell-shaped tube 54 has one end thereof secured to the water spray outlet 34, and the bell-shaped end thereof secured to a circular diaphragm 56 mountable within the housing 12. The diaphragm has a plurality of apertures 58 therein arranged in a partial circular pattern (FIG. 2) for producing a fan-shaped spray when the water is directed therethrough. The diaphragm 56 further has a nut 60 on the end thereof simulating a large nut on the end of an arm of a fire hydrant.

The control knob 52 is also movable to a second position diametrically opposed from the first position in which the valve body groove 32 directs the water from the water inlet nipple 22 into the hose water outlet 36, as best seen in FIGS. 1 and 5. One end of a hose 62 is connectable to the hose water outlet, and the opposite end thereof is connectable to an adjustable hose nozzle 64. When not in use, the hose end can be pressed into a nesting position between two resilient fingers of a hose receptacle 66 on the housing.

The control knob 52 can also be moved into an "off" position (FIG. 4), in which the L-shaped valve body groove 32 is closed off by the inner surface of the casing 26. Lastly, the control knob 52 can be moved to a fourth position diametrically opposed from the "off" position, as best seen in FIGS. 3 and 4. In this fourth position, the valve body groove 32 directs water from the water inlet nipple 22 into head water outlet 38 for directing water into a mechanism for generating twirling and pulsating streams of water.

With reference to FIGS. 1, 3, 5, and 6, the mechanism for generating twirling and pulsating streams comprises a main circular support plate 68 interposed between spaced apart annular ribs 70, 72 radially extending inwardly from the sprinkler housing 12. The plate 68 has a plurality of water drainage apertures 74, and a depending tube 76 securably connected to the head water outlet 38. The plate 68 further has an upwardly extending cup-shaped mouth 78 having an opening 80 in alignment with the head water outlet 38. A cylindrical funnel chamber 82 has a lower open end 84 nesting within the mouth 78, and an upper cap end 86 having a central collar 88 which rotatably supports a hollow valve body 90 of a pulsating valve 92. The valve body 90 is secured to a depending tube 94 (FIGS. 1 and 5) of a nozzle bar member 96, which bears on the collar 88. The bar member or sprinkler head has arms 98 having a central passage 100 leading to oppositely directed nozzles 102 having jet outlets 104 at the ends of the nozzles. Water from the head water outlet 38 is directed through the chamber 82, valve body 90, nozzle bar passage 100, and nozzle jet outlets 104 in a stream 105 at right angles to the nozzle bar member 96 causing the bar to twirl in the direction indicated by the arrows in FIG. 5 for generating steady twirling streams of water.

The upper surface of the nozzle bar member 96 is provided with a pair of spaced blocks 106 having grooves 108 therein for receiving U-shaped ends of a pair of flanges 110 depending from the inner surface of a dome top 112, as best seen in FIGS. 1 and 5. The dome top spins with the nozzle bar member 96, which is appealing and entertaining to children, and cooperates with the remainder of the housing 12 to simulate a fire hydrant. The dome top 112 further has ports 114 extending therethrough in alignment with the jets 104 (FIG. 6) to allow the twirling stream 105 to be discharged by the sprinkler onto a lawn.

Figure 6:
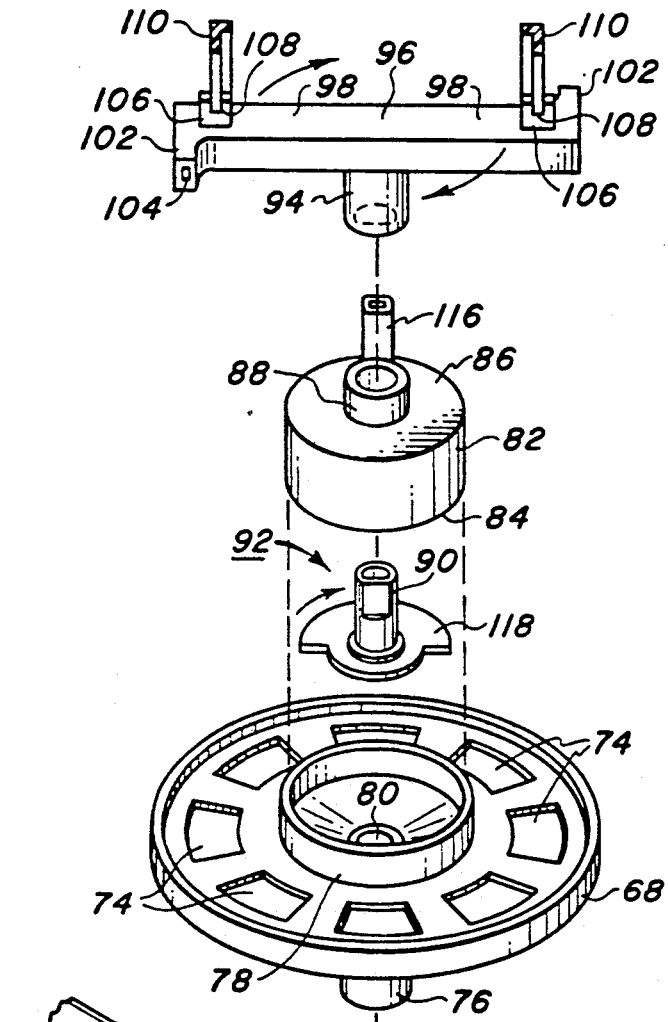
FIG. 6 is a segmental view partially in section taken substantially along line 6—6 of FIG. 1.
Figure 6:
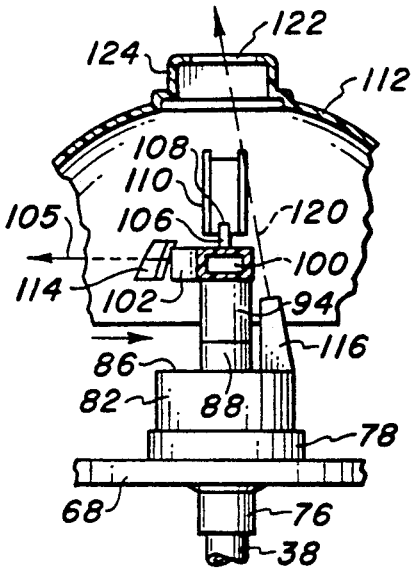

The chamber cap 86 is further provided with an upwardly directed spout 116 adjacent the periphery of the chamber 82, as best seen in FIGS. 3, 5, and 6. The valve body 90 of the pulsating valve 92 is further provided with a radially extending segmental circular plate 118 within the chamber which is adapted, upon rotation of the nozzle bar member 96 to open and close the spout 116. The intermittent opening and closing of the spout results in the formation of a pulsating stream 120 of water discharged therefrom through a central opening 122 in the apex 124 of the dome top, as best seen in FIG. 6. The apex 124 of the dome top is further formed in the shape of a large nut on the top of a fire hydrant.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A water sprinkler toy having a water inlet adapted to be connected to a pressurized water source for simultaneously discharging twirling and pulsating streams of water comprising:

a chamber hydraulically connected tot he water inlet and having first and a second water outlet;

a rotatably mounted hollow nozzle member having a jet outlet and hydraulically connected to the first water outlet, the nozzle member being rotatably driven by the pressurized water passing therethrough for discharging a generally horizontal twirling stream of water from the jet outlet; and pulsating valve means rotatably mounted within the chamber and coupled to the nozzle member and rotatably driven thereby for intermittently opening and closing the second water outlet for discharging a generally vertical pulsating stream of water simultaneously with the discharging of the twirling stream.

2. A water sprinkler toy according to claim 1 wherein the first water outlet comprises a collar, and the pulsating valve means comprises a valve body having a hollow stub shaft rotatably mounted with the collar and secured tot he nozzle member for rotation therewith.

3. A water sprinkler toy according to claim 2 wherein the valve body has a plate radially extending from the stub shaft for intermittently blocking passage of water through the second water outlet during each rotation of the valve for discharging a pulsating stream.

4. A water sprinkler toy according to claim 3 wherein the plate is substantially semi-circular in shape and is synchronized with the nozzle member for blocking the second water outlet during passage of the nozzle member thereover.

5. A water sprinkler toy accordingly to claim 4, and further comprising a spout extending outwardly from the second water outlet, and a dome top mounted on the nozzle member for rotation therewith, the dome top further having a port extending therethrough in alignment with the jet outlet, and an opening in the dome top in alignment with the spout.

6. A water sprinkler toy according to claim 5, and further comprising a separate spray water outlet, and a selective rotary valve means interposed between the water inlet and the chamber and spray outlet for selectively directing pressurized water into one of the chamber and spray outlet.

7. A water sprinkler toy according to claim 6, and further comprising a separate hose water outlet for discharging water into a hose attachable thereto, the selective rotary valve further having another position for directing water from the water inlet only into the hose water outlet.

8. A water sprinkler toy according to claim 7 and further comprising an exterior housing which in conjunction with the dome top simulates a colorful fire hydrant.

9. A twirling pulsing sprinkler comprising:

a generally cylindrical sprinkler housing having an end cap;

a funnel chamber having a water inlet, a water outlet in the end cap, and a water spout;

a valve body rotatably mounted in the funnel chamber;

a sprinkler head mounted on the funnel chamber and comprising at least one jet outlet for imparting a rotational motion to the sprinkler head when water is expelled from the jet outlet for producing a rotatable stream of water;

means coupling the sprinkler head tot eh valve body for rotating the valve body in synchronism with the sprinkler head and for hydraulically connecting the funnel chamber to the sprinkler head; and spout control means on the valve body for intermittently opening the spout to a flow of water in synchronism with the rotation of the sprinkler head for producing a pulsating stream of water from the water spout.

10. The twirling pulsing sprinkler of claim 9, in which the valve body comprises a hollow water carrying stub shaft extending through the water outlet in the end cap.

11. The twirling pulsing sprinkler of claim 10 in which the sprinkler head comprises first and second outwardly extending arms and the opposed nozzles are disposed at the ends of the arms.

12. The twirling pulsing sprinkler of claim 11 in which the sprinkler head is attached to the water carrying stub shaft.

13. The twirling pulsing sprinkler of claim 12 in which the spout is disposed adjacent the periphery of the end cap.

14. The twirling pulsing sprinkler of claim 13 in which the spout control means comprises disk means attached to the water carrying stub shaft.

15. The twirling pulsing sprinkler of claim 14 in which the disk means has a non-circular shape arranged to block the spout when the arms are over the spout and to open the spout when neither of the arms is over the spout.

* * * * *